US005097401A

United States Patent [19]

Eppler

[11] Patent Number: 5,097,401

[45] Date of Patent: Mar. 17, 1992

[54] INDIRECT LIGHTING MODIFIERS FOR USE WITH FLUORESCENT FIXTURES

[76] Inventor: Ross Eppler, 2111 Vine St., Suite B, Berkeley, Calif. 94709

[21] Appl. No.: 550,715

[22] Filed: Jul. 9, 1990

[51] Int. Cl.[5] ..... F21V 7/12

[52] U.S. Cl. ..... 362/298; 362/223; 362/346; 362/360; 362/361

[58] Field of Search ..... 362/359, 360, 361, 346, 362/217, 222, 223, 260, 298, 224, 300, 347

[56] References Cited

U.S. PATENT DOCUMENTS

| | | | |
|---|---|---|---|
| 1,286,535 | 12/1918 | Cochran | 362/346 |
| 2,202,266 | 5/1940 | Phillips | 362/223 |
| 4,112,483 | 9/1978 | Small, Jr. et al. | 362/217 |
| 4,748,547 | 5/1988 | Baker | 362/217 |

*Primary Examiner*—Ira S. Lazarus
*Assistant Examiner*—Sue Hagarman

[57] ABSTRACT

A luminaire providing indirect light from a tubular lamp-fixture assembly (55) which is mounted on a wall (65) and covered by a shield (25) which reflects light (3,4,7) upwardly toward a spreader (15) which substantially spreads light (2-7) out from a square corner and broadly over a ceiling (75) mounted under. The spreader and the shield both have quarter-cylindrically-shaped middle portions (10,20) over most of their lengths. The spreader has quarter-trumpet-shaped end-portions (14,16). The shield has quarter-bowl-shaped end-portions (24,26). The combination of the shield and the spreader also disperses light (8,9) substantially away from the sides of the luminaire. Both the shield and the spreader are made light-weight, flexible, and durable. A bracket (83) supports the shield away from the wall (65) mounted over, allowing an accenting strip of light (1) to surround the sides and lower edge of the shield. An adjustable bracket assembly (33,43,130) permits the parallel alignment of the shield with the wall.

7 Claims, 4 Drawing Sheets

INDIRECT LIGHTING MODIFIERS FOR USE WITH FLUORESCENT FIXTURES

BACKGROUND—FIELD OF INVENTION

This invention relates generally to lighting, specifically to an indirect lighting luminaire.

BACKGROUND—DISCUSSION OF PRIOR ART

Two major varieties of electric light sources exist: those that originate from point sources and those that originate from linear sources. In practice, ordinary incandescent light bulbs comprise point sources, whereas tubular lamps, including fluorescent tube lamps, comprise linear sources. Linear sources typically provide broader area illumination than do point sources of equivalent intensity. Numerous fixtures or luminaires which use a linear source of light have come into existence, especially since the advent of flourescent tube lighting. Many were intended to be mounted on ceilings, but wall mounting was also common, particularly where indirect lighting was desired.

Most overhead linear source lighting fixtures simply altered direct light by diffusion, refraction, or by shielding objectionable views of the lamps. While they provided a large quantity of light, the harsh glare of direct light was disturbing, and the resulting high lighting contrast produced eye strain. Embellishing the housing to make the fixture an attractive object merely distracted the eye and did little, at best, to improve the lighting effect. In certain environments, such as in rooms with computer monitors, the severe glare on monitor screens from overhead direct lighting was disastrous.

One variety of suspended flourescent fixture directed most of its light upward from a position below a ceiling, and spread light indirectly by reflection from the ceiling surface. While this provided indirect ceiling light, it also produced relatively bright areas directly above the fixture. Often, architectural coves or valances were positioned above or around the fixture; these spread the upwardly directed light by reflection from the coves, and/or from the walls and ceilings. However, they were expensive. Also, many were intended to merely obscure the light source. In addition, some coves were built with square corners and poorly reflecting inner surfaces which trapped and absorbed light. Moreover, all of these indirect sources created localized areas of severe brightness on the illuminated surface.

Some luminaires had angled or curved inner surfaces which operated to spread light more broadly, or had highly reflective finishes for greater efficiency in total light output. The specially curved reflector in U.S. Pat. No. 4,517,631 to Mullins, May 14, 1984, provided overhead illumination with a hidden linear light source, but the distribution of light was still limited by the rectangular perimeter of the fixture housing.

Despite the improvements, important detractions were still in evidence. For example, prior luminaires have not compensated for the areas left in darkness near the ends where, typically, tubular lamps are socketed. They also generally had blunt or squared off ends which cast sharp shadows, such as did the fixture in the foregoing patent to Mullins. As a consequence, spaced plural luminaires in a room often left bands of relative darkness between them.

In small rooms or rooms with a low ceiling, overhead fixtures got in the way, or often the eye-distracting presence of the fixture in the middle of a ceiling remained objectionable, even in rooms with normal height. Coves mounted lower on walls also proved inadequate since their light tended to shine in people's faces and was blocked by bodies or objects in the room. Also, most wall-mounted cove luminaires were made to mount tightly against a wall so that light was only directed upward, leaving areas below and to the sides in darkness. Valance luminaires directed a considerable amount of light downward where it was useless for most practical tasks. To provide uniform indirect light, especially light which fills a room from a source above "head" level, one generally had to custom build a cove, along a wall, or around the perimeter of a room. Often these were also located close to a ceiling or in or below a soffit.

Architectural coves must accomodate the imperfections inherent to the construction process, and were usually custom built. As a result, they were labor-intensive, and not easily mass-produced. It was especially costly to eliminate light-trapping square corners and even more expensive to build curved surfaces. Access to the fixtures and lamps was most often limited, making relamping and cleaning difficult.

There were also various self-contained luminaires for providing cove or valance lighting. While these often incorporated curved metal parts for improved reflection, they were typically expensive, bulky, heavy, had limited accessability to mounting hardware, and therefore, were difficult to mount and align during installation. Fixture-gauge sheet metal parts bend rather easily, so denting and damage were not uncommon when these luminaires were shipped and installed. Also, painted surfaces were often easily scratched.

OBJECTS AND ADVANTAGES

Accordingly, several objects and advantages of the present invention are to provide a luminare which covers objectionable views of fixtures and lamps, which produces a distribution of light in a room which is substantially omnidirectional so people and objects in the room do not cast noticeable shadows, and whose visible surfaces have less glare than those of direct lighting sources; to provide a luminaire which is less likely to be an obstruction in a room, especially where the ceiling is unusually low; to provide a luminaire which improves the spreading of light out from square corners, and which operates to fan light away from the socketed ends of tubular lamps incorporated in the luminaire, reducing shadow lines at the edges of the luminaire, and reducing bands of darkness between spaced plural luminaries; and to provide a luminaire comprised of components which are easily installed and removed for improved lamp and fixture accessability, which are light in weight, made from durable and flexible materials, and resistant to scratching, deformation, and breakage.

Additional objects and advantages are to provide a luminaire mounting bracket which suspends a light modifier away from a mounting surface so that an accenting strip of light shines out along the entire perimeter of the modifier onto such surface, below, and to the sides of the modifier, also providing some illumination below and to the sides of the luminaire; to provide a partially transparent mounting bracket which provides the illusion that the modifier is suspended without support; and to provide an adjustable bracket which aligns the luminaire with its mounting surface, even when the surface is somewhat uneven; to provide a luminaire which combines with standard, commonly available and inexpensive fluorescent lamp fixtures, while hiding end views of same, and to provide a luminaire having light modifiers which can be mounted after installing the lamp-fixture.

Further advantages will become evident from the ensuing drawings and description of the invention and its variations.

DRAWING FIGURES

Figure 14:
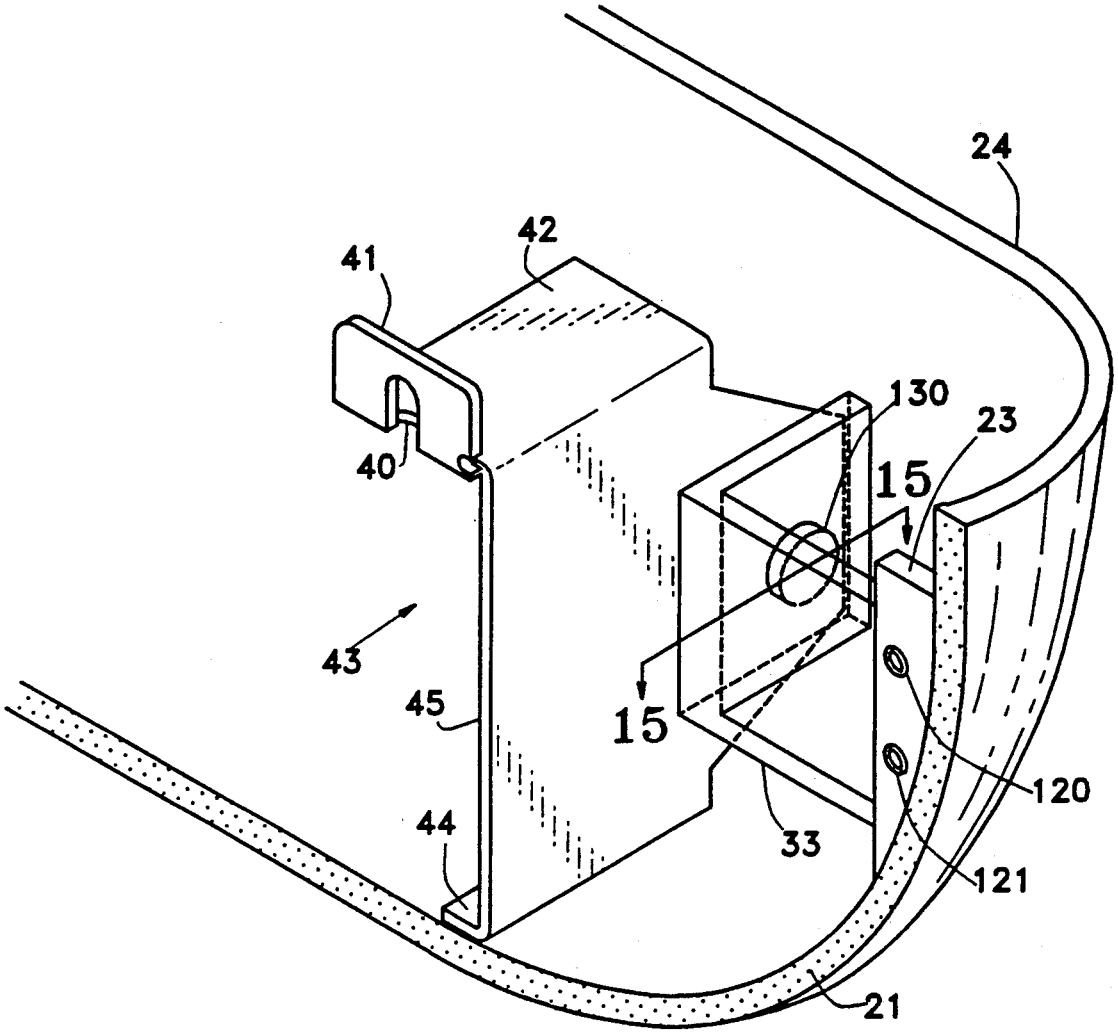
FIG. 14 is a view of the back of the preferred bracket as seen from slightly above and right of center, shown assembled with the support and the shield-mounting tab which is attached to the left end of the shield.
Figure 15A:
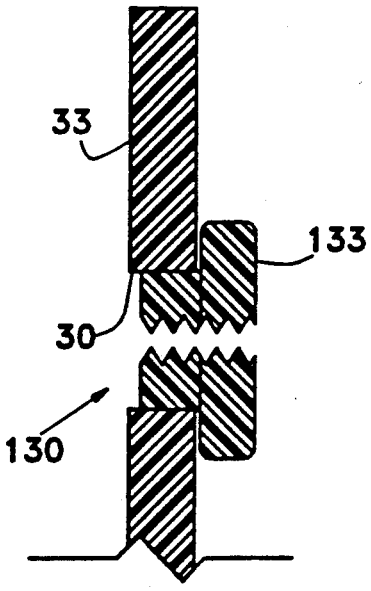

FIG. 15*a* is a sectional view of a knurled and threaded nut taken along the line 15—15 of FIG. 14 showing a shoulder portion and a bushing portion of the nut.

Figure 15B:
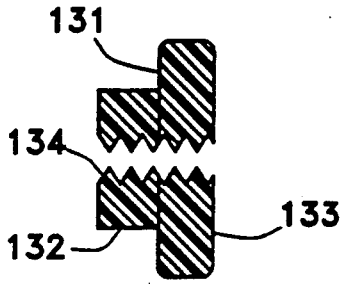

FIG. 15*b* is a sectional view taken along the line 15—15 of FIG. 14 of the nut and a portion of the support showing the nut inserted into a hole in the support.

DRAWING REFERENCE NUMERALS

1-9 reflected light rays
10 spreader concave quarter-cylinder middle portion
11 spreader border strip
14 spreader left-end quarter-trumpet-shaped portion
15 entire spreader part of the luminaire
16 spreader right-end quarter-trumpet-shaped portion
20 shield convex quarter-cylinder middle portion
21 shield perimeter-reinforcing bend
22 alternative shield mounting-skirt portion
23 shield-mounting tab for portion 24
24 shield left-end quarter-bowl-shaped portion
25 entire shield part of the luminaire
25' alternate shield part of the luminaire
26 shield right-end quarter-bowl-shaped portion
30 hole in support 33 for admitting bushing portion 132
33 support for joining tab 23 to bracket 43
40 mounting slot in portions 41 and 42 of bracket 43
41 tab portion of bracket 43
42 slab portion of bracket 43
43 entire preferred left-end shield-mounting bracket
44 foot portion of bracket 43
45 side portion of bracket 43
50 box portion of tubular lamp-fixture assembly 55
51 lower lamp of assembly 55
52 upper lamp of assembly 55
55 entire lamp-fixture assembly of lamps 51 and 52 with box 50
65 portion of wall near corner where ceiling 75 joins
75 portion of ceiling near corner where wall 65 joins
83 basic shield-mounting bracket
120 upper fastener for joining support 33 to tab 23
121 lower fastener for joining support 33 to tab 23
130 female-threaded nut
131 shoulder portion of nut 130
132 bushing portion of nut 130
133 knurled portion of nut 130
134 threaded hole through nut 130
140 male-threaded stud
150 spreader-mounting hook strip for catching hanger 170
153 adhesive strip for adhering spreader 15 to hook 150
161 adhesive strip for adhering border 11 to wall 65
165 mounting screw secured to wall 65
170 hanger strip for supporting hook 150
171 adhesive strip for adhering spreader 15 to ceiling 75
175 mounting screw for securing hanger 170 to ceiling 75
261 upper transparent pinstriped area on painted shield 25
262 beveled revealing stripe on painted shield 25
263 lower transparent pinstriped area on painted shield 25
267 inset revealing stripe on painted shield 25

BASIC VERSION—DESCRIPTION

Figure 1:
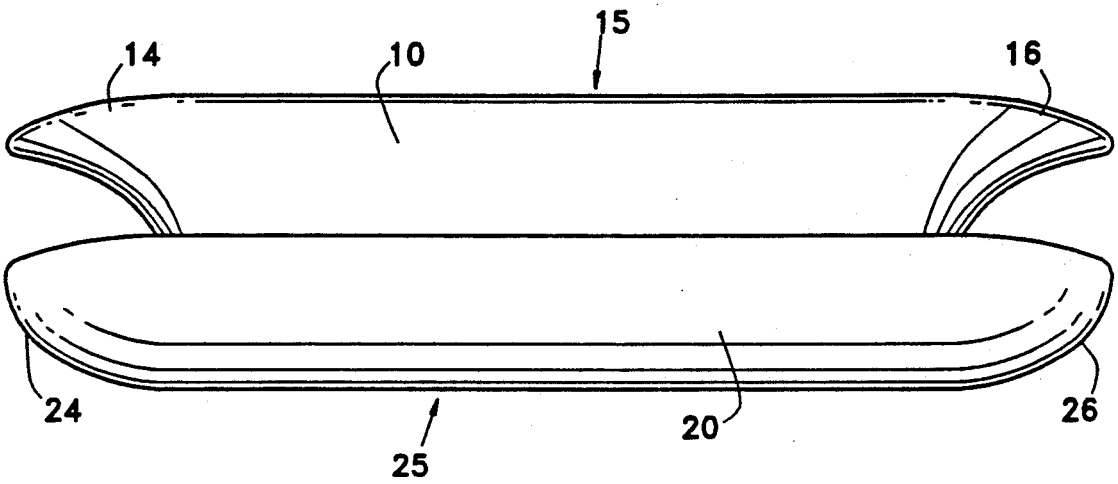
FIG. 1 is a view of the front of an entire luminaire according to the invention as seen from slightly below, and showing left end, middle, and right end portions of the luminaire.

FIG. 1 shows a luminaire according to a basic version of the invention. It comprises two separate major parts: a spreader 15 and a shield 25 which is mounted below the spreader. The spreader and the shield are preferably made from vacuum-formed, flexible, and opaque sheet plastic. Their lengths are substantially equal. They are spaced apart, with the spreader mounted just above the shield, as better shown in FIG. 3.

Spreader 15 (FIG. 1) has a middle portion 10 comprising a concave quartercylinder having an inner radius of about 15.2 cm, or six inches. The spreader also has quarter-trumpet-shaped end portions 14 and 16. A left-end portion 14 joins middle portion 10 along a common arc near the left end of the spreader. The common arc is better appreciated in FIG. 2 where it corresponds to the curved part of the view of the end of left-end portion 14. A right-end portion 16 also joins middle portion 10 along a substantially identical common arc near the right end of spreader 15. The entire concave surface of the spreader preferably has a matte white finish.

Similarly, shield 25 has a middle portion 20 comprising a convex-quarter-cylinder having an inner radius of about 15.2 cm, or six inches. Shield 25 also has concentric quarter-bowl-shaped end portions 24 and 26. A left-end portion 24 joins middle portion 20 along a common arc near the left end of the shield. The common arc is better appreciated in FIG. 2 where it corresponds to the curved part of the view of the end of left-end portion 24. A right-end portion 26 also joins middle portion 10 along a substantially identical common arc near the right end of the shield. The entire outer convex surface of the shield is matte white. The inside surface of shield 25 has a reflective gloss white finish.

Light Source

Figure 4:
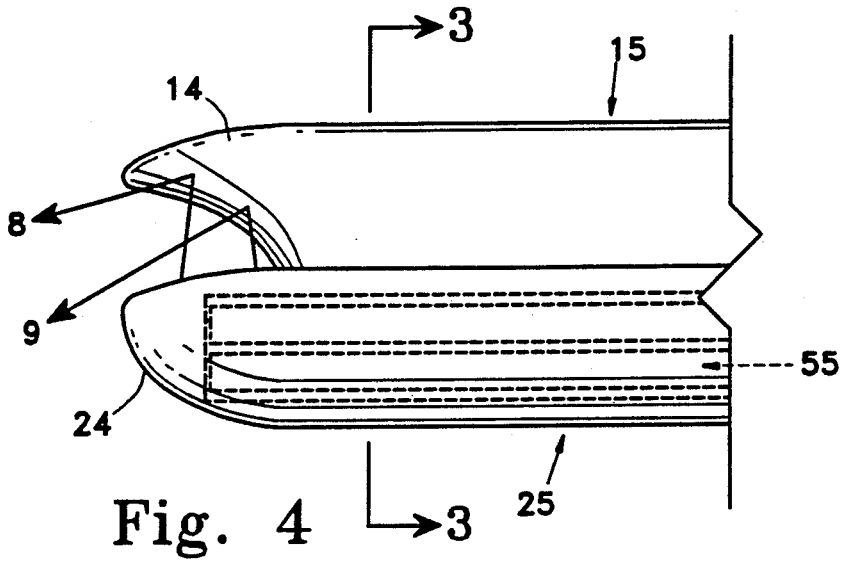
FIG. 4 is a view of part of the front of the luminaire as seen from slightly below its left end.
Figure 12:
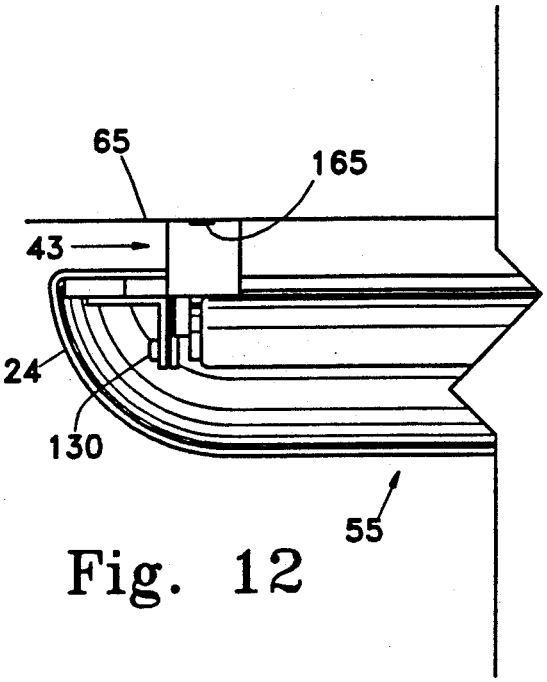
FIG. 12 is a similar view of such shield and the assembly of FIG. 5, but shown installed in front of the lamp-fixture, and showing the preferred bracket secured to a wall with a mounting screw.

A dual tubular lamp-fixture, assembly 55, shown in FIG. 2, mounts behind shield 25 and below spreader 15. Assembly 55 is a standard open-strip-type of fluorescent fixture about 1.2 meters, or four feet in length. As shown in FIG. 4, the shield and the spreader are each longer than assembly 55. However, midportions 10 and 20 are each shorter than the assembly. A box 50, and a pair of lamps 51 and 52, comprising assembly 55, are all substantially equal in length. Consequently, the lamps are positioned so that they extend partway into the space surrounded by end portions 14 and 24, as shown in FIGS. 4 and 12, and the space surrounded by end portions 16 and 26 (not depicted).

Spreader Mounting

Figure 3:
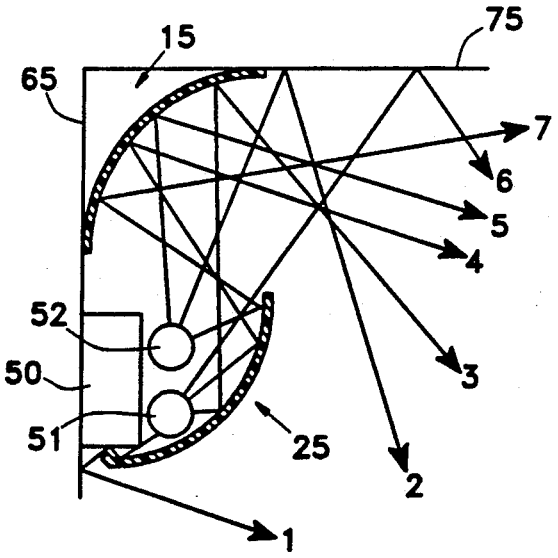
FIG. 3 is a sectional end view of the luminaire taken along the line 3—3 of FIG. 4.
Figure 5:
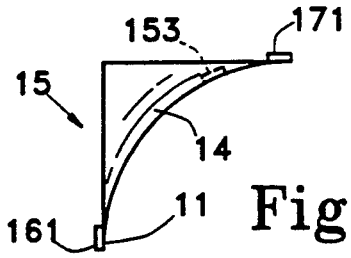
FIG. 5 is a view of the left end of a spreader part of the luminaire showing adhesive strips (exaggerated) applied to a border strip of the spreader, and applied to the top edge of the spreader.

Spreader 15 is mounted in the corner where a wall 65 and a ceiling 75 join, as shown in FIG. 3. A continuous length of double-sided foam-core adhesive strip 171, as seen a view of the end in FIG. 5, is approximately 1.6 mm or one-sixteenth inch thick, and thirteen millimeters, or one-half inch wide. Strip 171 adheres to the entire top front edge of the spreader, and also to ceiling 75 when the spreader is mounted, securing it thereon. A border strip 11 of spreader 15 extends about 2.5 cm, or one inch, straight below middle portion 10. Border 11 is shown in FIG. 5 with an adhesive strip 161 applied to its backside. Strip 161 has substantially identical composition and dimensions as strip 171. Strip 161 adheres to wall 65 when the spreader is mounted, securing it thereon.

Shield Structure and Mounting

A perimeter-reinforcing bend 21 covers the entire back edge of shield 25 (FIG. 2), and is better shown by the view of the back of the shield in FIG. 14. A shield-mounting tab 23 (FIG. 2) is made from the same material as the shield's left-end portion 24. Tab 23 extends from just below the top rim of the shield to about the midpoint of the curved portion of bend 21. The tab is shaped to conform to the inner curve of portion 24, and is solvent-welded thereon just inside and parallel to the plane of the bend, as better shown in FIG. 14. A tab (not shown) substantially identical to tab 23 is similarly attached to the shield's right-end portion 26.

Figure 7:
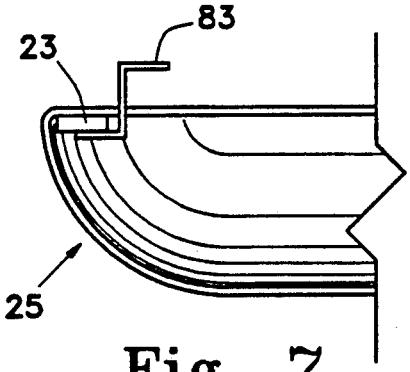
FIG. 7 is a view of part of the top of the shield part of the luminaire, including its left end, and showing a basic shield-mounting bracket attached to a shield-mounting tab.

A basic left-end shield-mounting bracket 83 is shown from above in FIG. 7. Bracket 83 is made from transparent plastic, and has two short parallel legs joined by a longer leg which is perpendicular to the shorter legs; all three together look generally like a squared-off backward "Z". One short leg of the bracket is attached to tab 23 with fasteners (not shown). The other short leg is fastened to wall 65 (not shown), and the longer leg of the bracket supports tab 23 which supports left end 24 away from wall 65 (not shown) when shield 25 is mounted (not depicted). A similar right-end bracket (not shown) supports right end 26 in similar fashion.

Basic Version —Operation

Lamp-fixture assembly 55 (FIGS. 2–4), provides the linear source of light which is modified by the combination of shield 25 and spreader 15. FIGS. 3 and 4 show various light rays which emanate from the luminaire.

The luminaire disperses light out from a square corner as shown in FIG. 3. Concentration of light in the area close to the corner where wall 65 and ceiling 75 join, is reduced by spreader 15. Light is instead dispersed broadly over a portion of the ceiling. Various light rays from lamps 51 and 52, such as rays 1 through 7, reflect from one or more surfaces, including the mutually facing surfaces of the shield and the spreader. Rays 1 through 7 reflect at numerous angles which are radial and normal to the long axes of the lamps. The shield directs a substantial portion of light toward the spreader, represented by rays 3, 4, and 7. Some light, represented by rays 2 and 6, escapes over the top rim of the shield and shines directly onto the ceiling.

Figure 2:
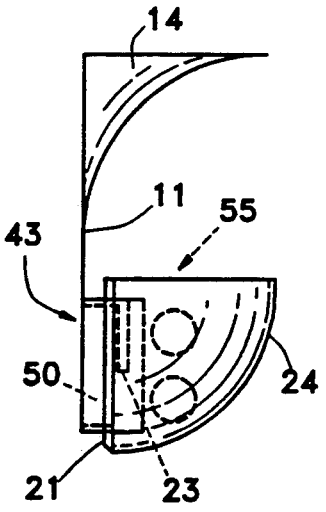
FIG. 2 is a view of the left end of the luminaire of FIG. 1.

The combination of left-end portion 14 of spreader 15 and left-end portion 24 of shield 25 is shown in FIGS. 1,2, and 4. Most of the light from those parts of the lamps which extend into the space surrounded by portion 24 is directed by it toward left-end portion 14 of the spreader. Portion 14 further directs the light away from the left end of the luminaire at various angles both normal and non-normal to the axes of the lamps. Light rays 8 and 9 in FIG. 4 are examples of rays directed away from the left end of the luminaire. Light fans out in a similar fashion (rays not shown) from the combination of right-end portion 26 and right-end portion 16 shown in FIG. 1. The light which fans away from the ends of the spreader illuminates the wall and the ceiling over areas which are substantially longer than the luminaire.

An accenting strip of light is represented by ray 1, which is a relatively smaller quantity of light which shines on the wall along the perimeter of the shield, below, and to its sides, and which provides some illumination in these directions. Left-end shield-mounting bracket 83 is in the path of the accenting strip of light, but does not cast a noticeable shadow since it is transparent. The same is true for the right-end shield mounting bracket (not shown).

Installation

To install the luminaire, an installer first mounts a commonly available, standard, open-strip-type fluorescent lamp fixture, such as box 50 in FIG. 3, on wall 65, positioned as shown. Box 50 is affixed thereon with appropriate fasteners (not shown), and appropriately supplied with electrical power (not depicted). Lamps 51 and 52 are installed after the spreader has been mounted, or immediately after box 50 has been mounted and supplied if the lamp-fixture assembly is to be used for illumination during the earlier phases of construction when the spreader and shield might be marred.

The installer next makes an appropriate mark (not shown) on the wall above, and near one end, of assembly 55 (FIG. 4) for aligning spreader 15 over it. The spreader is provided to the installer with adhesive strips 161 and 171 preapplied to the back and upper sides of it, at the locations shown in FIG. 5. The installer then positions the spreader at or near the mark on the wall, holding it slightly away from the wall, slightly below the ceiling, and oriented approximately as shown in FIG. 3. Next, the installer pushes the spreader into the corner where the wall and the ceiling join, bringing strip 161 into contact with the wall, and strip 171 into contact with the ceiling, each at their appropriate locations (not depicted). Finally, pressure is applied along the entire top and bottom edges of the spreader, in front of the adhered strips, and toward the ceiling and the wall, respectively.

Figure 11:
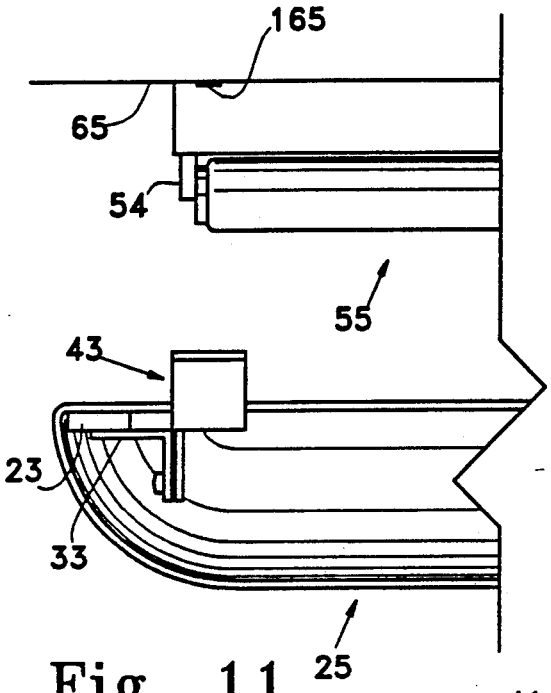
FIG. 11 is a view of part of the top of the shield in FIG. 7, including its left end, and a view from above the assembly of the shield-mounting tab, a support, and a preferred left-end shield-mounting bracket, all shown adjacent to a tubular lamp-fixture assembly, but not yet installed according to the invention.

To mount the shield in front of assembly 55, the installer first makes an appropriate pair of marks (not shown) on the wall, in order to locate a shield-mounting fastener near each end of assembly 55, such as screw 165 in FIG. 11. The installer then attaches bracket 83 in FIG. 7 to the wall 65 (not shown), with a fastener (not shown), and similarly attaches the right-end bracket (not depicted) to the wall.

Alternative Versions—Description

Figure 6:
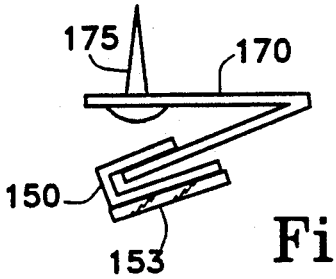
FIG. 6 is an end view of a spreader-mounting hook strip and a hanger strip shown with an adhesive strip applied to the hook and a securing screw inserted through the hanger.

An alternative method for mounting spreader 15 employs a hanger strip 170 and a spreader-mounting hook strip 150, shown in the view of the end in FIG. 6. Hanger 170 is roughly "V" shaped, with one leg of the "V" longer than the other. The long leg of the hanger is attached to ceiling 75 (not shown) with several screws, such as screw 175. Hook 150 is shaped generally like a squared-off "J" having a short leg and a long leg. An adhesive strip 153 in FIG. 6 is adhered to the outside of the long leg of the "J". Strip 153 is similar to strips 161 and 171, and is adhered just behind and along the front top edge of spreader 15, affixing hook 150 (not depicted) thereon.

When the spreader is mounted with the hook and the hanger, strips 161 and 171 in FIG. 5 are not used. Instead, the short leg of the hanger engages the short leg of the hook as shown in FIG. 6. The engaged combination of the hook and the hanger supports the upper side of the spreader (not depicted). The lower side of spreader 15 (FIG. 5) is supported by several screws installed through its border and into wall 65 (not depicted).

Alternative Shield

Figure 8:
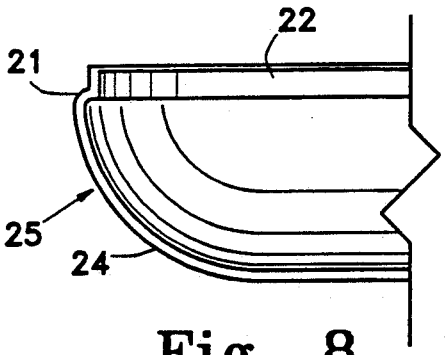
FIG. 8 is a view of part of the top of an alternative shield, including its left end, and a shield mounting-skirt shown adjoined to a shield perimeter-reinforcing bend.

An alternative shield 25' in FIG. 8 employs a mounting-skirt portion 22 which adjoins to bend 21 along the entire back edge of the bend. Skirt 22 has a generally "L" shaped cross-section (not shown), has one leg of the "L" which is perpendicular to the plane of bend 21 and adjoined thereto, and has another leg of the "L" which is parallel to the plane of the bend. The portion of the skirt which is parallel to the plane of the bend is partially open at the back for admitting assembly 55. Alternative shield 25' is mounted (not depicted) to a surface with fasteners installed through holes (not shown) in the portion of skirt 22 which is parallel to bend 21.

Shield Materials and Finishes

Figure 9:
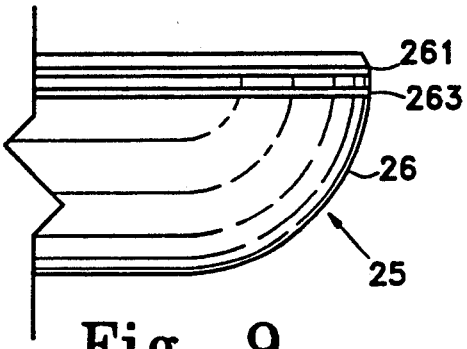
FIG. 9 is a view of part of the front of the shield in FIG. 7, including its right end, composed of transparent material which is painted opaque except where the underlying transparent material is revealed by a pair of pinstriped areas.
Figure 10:
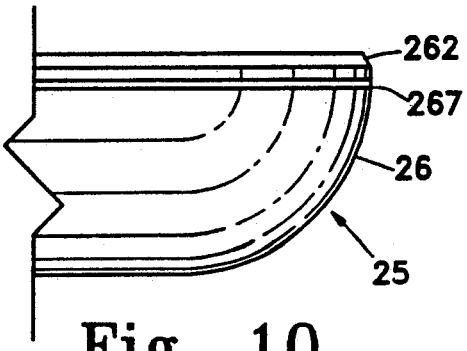
FIG. 10 is a similar view of such shield, but composed of opaque material shown painted except where the underlying material is revealed a beveled stripe and by an insert stripe which penetrate the paint.

FIG. 9 shows a view of part of the front of the right end of shield 25; it is made from transparent plastic which has been painted with an opaque color. A transparent pinstriped area 261 is revealed near the top edge of the shield and spans the entire front surface of the shield. A similar pinstriped area 263 is revealed just below area 261. FIG. 10 shows a similar view of shield 25, but made from white opaque plastic which has been coated with an opaque paint. A beveled revealing stripe 262 penetrates the paint coating, spans the entire top edge of shield 25, and exposes the white plastic under the paint. A similar inset revealing stripe 267 spans the entire front of the shield just below stripe 267, also exposing the white plastic under the coating of paint.

Preferred Shield-Mounting Bracket

FIG. 14, in a view from behind, shows an assembly of a preferred left-end shield-mounting bracket 43, an "L" shaped support 33, and tab 23 which together support portion 24 of the shield. Support 33 is shown attached to tab 23 by a pair of fasteners 120 and 121 which extend through concentric holes (not shown) in the tab and the support. FIG. 12, in a view from above, shows a portion 24 near the left end of the shield supported away from wall 65 by such assembly, and secured thereon by a wall-mounting screw 165.

Figure 13:
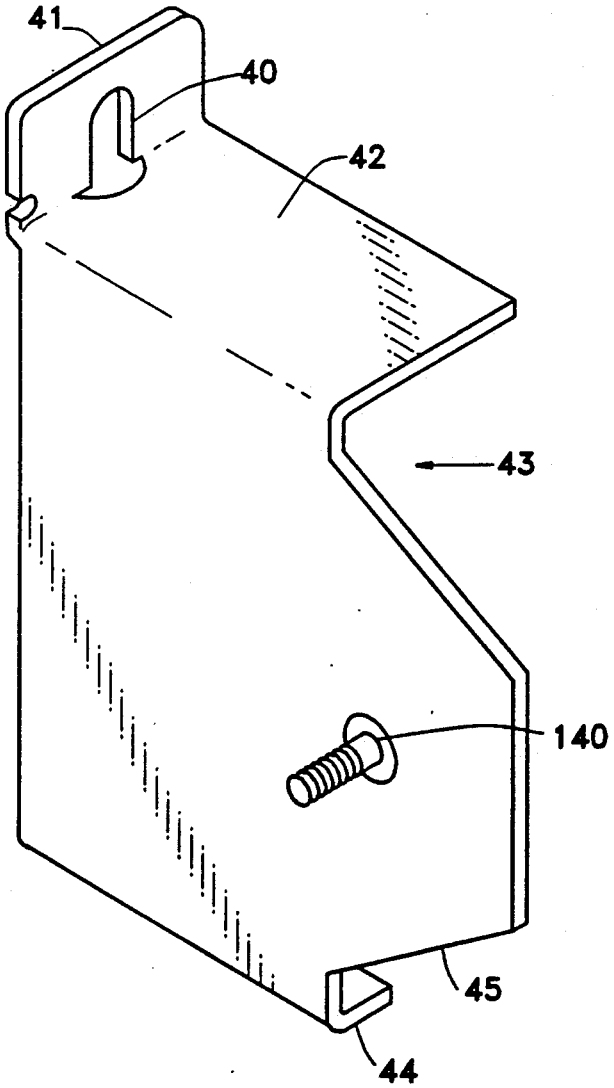
FIG. 13 is a view of the front of the preferred bracket as seen from slightly above and left of center and showing a threaded stud incorporated on its side portion.

Bracket 43, as shown in FIG. 13, comprises a sheared and bent piece of sheet metal having various portions. A tab portion 41 and a slab portion 42 are generally rectangular. A long bottom edge of vertically oriented tab 41 adjoins to a short back edge of horizontally oriented slab 42 at a bend which stiffens both portions. A side portion 45 is vertically oriented and generally trapazoidally shaped, having a long left edge about 10.2 cm, or four inches, in height, a short top edge and a short bottom edge, each adjacent to the left edge, a long angled edge adjacent to the top edge, a long angled edge adjacent to the bottom edge, and a short right edge adjacent to the angled edges. The width of side 45 from its left edge to its right edge is about nine centimeters, or three and one-half inches. The top edge of side 45 is adjoined to a long left edge of slab 42 at a second bend which stiffens both parts. A foot portion 44 is generally shaped like a long narrow rectangle, is horizontally oriented, and has a long left edge adjoined to the bottom edge of side 45 at a third bend which adds additional stiffness to side 45. The planes of slab 42 and foot 44 are parallel and both portions extend in a direction away from the back of side 45.

Bracket 43 in FIG. 13 includes a mounting slot 40 which is comprised of a long generally "U" shaped opening centered in tab 41, and an adjacent half-oval opening centered in slab 42. The "U" shaped portion of the slot is slightly wider than the diameter of a shaft portion of screw 165 (not shown), has its long dimension vertically oriented, and extends from the bottom edge of the tab to about two-thirds of the height of the tab. The half-oval portion of the slot is slightly larger than a head portion of screw 165 (not shown), has its long dimension oriented horizontally and parallel to the back edge of slab 42, and extends a short distance from the back edge, toward the front edge, of slab 42.

Side 45 (FIG. 13) incorporates a male-threaded stud 140 which is located on the face of side portion 45, approximately centered between its top and bottom edges, and located about nineteen millimeters, or three-quarters of an inch, to the left of its right edge. Stud 140, when assembled with a nut 130, secures support 33 to bracket 43 (such assembly shown in FIGS. 11, 12, and 14 but not showing stud 140).

A sectional view of nut 130 in FIG. 15*a*, taken along the line 15—15 of FIG. 14, shows a knurled portion 133 which is substantially cylindrical, a shoulder portion 131 which is flat and slightly roughened, a bushing portion 132 which is substantially cylindrical and smooth and flat, and a female-threaded hole 134 which mates with male-threaded stud 140. A sectional view of the nut inserted into support 33 in FIG. 15*b*, taken along the line 15—15 of FIG. 14, shows a hole 30 in the support. Hole 30 has a diameter slightly larger than the diameter of bushing portion 132 of the nut so that the support is free to rotate about the nut when the assembly (shown in FIGS. 11, 12, and 14) with stud 140 (not shown in FIGS. 11, 12, and 14) is loose.

A preferred right-end bracket (not shown) supports the right end of shield 25 in a similar fashion which incorporates a reciprocal assembly comprised of parts substantially identical to tab 23, support 33, fasteners 120 and 121, nut 130, and stud 140 (not depicted).

ALTERNATIVE VERSIONS—Operation

A preferred method for mounting spreader 15 is shown in FIG. 6. Hanger strip 170 is secured to an appropriate position on ceiling 75 (not shown), using several fasteners, such as screw 175. Hook strip 150 is provided to the installer attached to spreader 15 (not depicted) with an adhesive strip 153. The installer positions the spreader so that the hook is positioned near the ceiling and slightly closer to the wall than the hanger (not depicted). In this position the bottom edge of the spreader is spaced somewhat away from the wall while the top edge of the spreader is almost in contact with the ceiling. Next, the installer applies upward pressure near the top edge of the spreader, while pushing the bottom edge of the spreader toward the wall (not depicted). This engages the hook 150 with the hanger 170. Finally, border strip 11, at the bottom edge of the spreader, is secured to the wall (not depicted) with one or more fasteners (not shown).

Installing Alternative Shield

To mount an alternative shield 25', the installer fastens a shield mounting-skirt 22 (not depicted) to the wall with several fasteners (not shown), having first placed the partially-open back portion of skirt 22 (not shown) adjacent to assembly 55 so that shield 25' is located in a position substantially like the position of shield 25 shown in FIGS. 2 and 4.

Installing Shield with Preferred Shield-Mounting Bracket

A preferred left-end shield-mounting bracket 43 (FIG. 12) is assembled with support 33 which supports shield left end 24 away from wall 65, and hides end views of box 50, as shown in FIG. 2. The right-end bracket (not shown) supports shield right end 26, mounts on wall 65, and hides box 50 in a similar fashion. The installer attaches support 33 to tab 23 with fasteners 120 and 121, shown in FIG. 14 for the left end of shield 25, and then assembles the support, the bracket, and nut 130. Similar parts (not shown) are assembled and attached to the right end of the shield.

To mount shield 25, the installer first makes an appropriate pair of marks (not shown) on wall 65, one near each end of assembly 55, for locating a shield-mounting fastener, such as a screw 165 in FIG. 11. The installer then attaches screw 165 in order to secure the left end of the shield to the wall. A substantially identical screw (not shown) is also attached to the wall for supporting the right end of the shield. Both screws are set flush to the wall, then backed off slightly as shown in FIG. 11 for screw 165.

The installer then positions the shield in front of assembly 55 approximately as shown in FIGS. 2 and 4, but somewhat higher. Slot 40, in bracket 43, shown in FIGS. 13 and 14, is then aligned over screw 165 (not depicted). Next, the installer moves the shield down, sliding the half-oval portion of the slot in slab 42 around the head of the screw, and sliding the long "U" shaped portion of the slot in tab 41 behind the head and around the shaft of the screw until the shield hangs on the screw approximately as shown in FIG. 12. A similar procedure is followed for hanging the right end of the shield (not depicted). Finally, the installer appropriately adjusts the position of bracket 43, up or down, then tightens the screw 165 against tab 41 which contains the "U" shaped portion of slot 40 until the bracket is secured from slipping. Similarly, the right-end bracket is adjusted and its mounting screw (not depicted) tightened.

Nut 130, which is shown with support 33 in FIGS. 11, 12, and 14, is run onto the threaded shaft (not depicted) of stud 140, which is shown in FIG. 13 incorporated on the face of the side portion of bracket 43. The roughened surface of shoulder portion 131 of the nut shown in FIG. 15*a* provides some locking friction against the mating surface of support 33 when the nut is tightly seated thereon. The mating surfaces of the bracket and the support similarly provide some locking friction. The installer may rotate the support around bushing portion 132 of the nut shown in FIG. 15*a* where it is inserted through hole 30 in the support, shown in FIG. 15*b*, when the nut is not fully tightened against the support. The bracket attached to the right end of shield 25 (not shown) can be similarly rotated and locked into position with a nut substantially identical to nut 130. The shield can then be aligned parallel to the wall by appropriate adjustment, and finally, can be locked in position by tightening both of the foregoing nuts.

While the above description contains many specifics, the reader should not construe these as limitations on the scope of the invention, but merely as examples of preferred embodiments thereof. Those skilled in the art will envision many other possible variations that are within its scope. For example, those skilled in the vacuum-forming of plastic will be able to make molds in various sizes and having other shapes. Also, parts made from the same mold can be trimmed in a variety of ways. For example, the shield in FIG. 8 can be trimmed to produce the shield in FIG. 7. Numerous materials with various coatings, with or without designs, and having a variety of possible colors or combinations of colors can be applied to the shield other than those depicted in FIGS. 9 and 10. Both the spreader and the shield can be made from virtually any material, or by other processes, including formed sheet metal, carved wood or stone, or engraved or molded glass, and can have numerous types of finish, including highly polished or dull, smooth or textured, or patterned. Alternatives to the adhesive strips can be employed including the use of more ordinary fasteners, while the mounting screws depicted can instead be appropriate bolts, nails, or other fasteners. The reader should also appreciate that many other possible mounting brackets can be employed for supporting the shield or the spreader including single- and multiple-component brackets or clips made from metal, plastic, wood, or virtually any material. Further, while the luminaire is described as a combination unit, having a specific orientation, there is no reason why those with imagination could not use the shield and spreader independently for each of their light modifying properties, mounted in other orientations or locations than those shown. Also, a plurality of lamp-fixtures, shields and/or spreaders can be combined in various ways to achieve a variety of lighting effects.

Accordingly, the reader is requested to determined the scope of the invention by the appended claims and their legal equivalents, and not by the examples which have been given.

I claim:

1. A luminaire comprising:

a light spreader comprising an member having an elongated, concave light-reflective surface, said elongated concave surface having lower and upper sides when said spreader is mounted so that said elongated concave surface is horizontal, each end of said elongated concave surface flaring upwardly to form a concave curve which extends from said lower side to said upper side such that said concave curve flares away from said spreader and said upper side portion of said concave curve extends in a generally horizontal direction, said spreader having a generally quarter-round cross-sectional shape.

a light shield comprising and elongated member of generally the same length as said spreader, said shield being arranged to cover a light source, said shield having a convex, elongated surface having lower and upper sides when said shield is mounted so that said elongated convex surface is horizontal, each end of said convex surface curves downwardly to form a convex curve which extends from said upper side to said lower side such that said convex curve has a lower side portion which extends into said shield having a generally quarter-round cross-sectional shape, said shield having an upwardly facing, light-transmitting side such that light from said source will shine onto said concave surface of said spreader when said shield is mounted below said spreader and said spreader and said shield are substantially parrallel, and said spreader is mounted at the top of a wall adjacent to a ceiling, and said shield is mounted on a wall below said spreader.

2. The luminaire of claim 1 wherein said upwardly facing light-transmitting side of said shield is open.

3. The luminaire of claim 1 wherein said spreader has a matte white finish.

4. The luminaire of claim 1 wherein said shield has one linear source of light mounted therein.

5. The luminaire of claim 1 wherein said shield has two linear sources of light mounted therein, one of said linear sources being mounted under the other.

6. The luminaire of claim 1 wherein the upper edge of said shield is horizontally aligned with the lower edge of said spreader.

7. A luminaire comprising:

a light spreader comprising an member having an elongated, concave light-reflective surface, said elongated concave surface having lower and upper sides when said spreader is mounted so that said elongated concave surface is horizontal, each end of said elongated concave surface flaring upwardly to form a concave curve which extends from said lower side to said upper side such that said concave curve flares away from said spreader and said upper side portion of said concave curve extends in a generally horizontal direction, said spreader having a generally quarter-round cross-sectional shape, a light shield comprising and elongated member of generally the same length as said spreader, said shield being arranged to cover a light source, said shield having a convex, elongated surface having lower and upper sides when said shield is mounted so that said elongated convex surface is horizontal, each end of said convex surface curves downwardly to form a convex curve which extends from said upper side to said lower side such that said convex curve has a lower side portion which extends into said shield having a generally quarter-round cross-sectional shape, said shield having an upwardly facing, light-transmitting side such that light from said source will shine onto said concave surface of said spreader when said shield is mounted below said spreader and said spreader and said shield are substantially parrallel, and wherein said shield is partially reflective and partially transluscent.

* * * * *